US005984364A

United States Patent [19]

Diamond

[11] Patent Number: 5,984,364

[45] Date of Patent: Nov. 16, 1999

[54] NEGOTIABLE DOCUMENT HAVING ENHANCED SECURITY FOR DETERRING GENERATION OF COPIES BY USE OF THERMOCHROMATIC INK

[75] Inventor: Robert I. Diamond, Alpine, Utah

[73] Assignee: Diamond Security, Inc., Alpine, Utah

[21] Appl. No.: 08/933,624

[22] Filed: Sep. 12, 1997

Related U.S. Application Data

[63] Continuation-in-part of application No. 08/731,055, Oct. 9, 1996, Pat. No. 5,785,353, which is a continuation-in-part of application No. 08/333,542, Nov. 2, 1994, Pat. No. 5,575,508, which is a continuation-in-part of application No. 08/241,798, May 12, 1994, Pat. No. 5,538,290.

[51] Int. Cl.[6] ..... B42D 15/00

[52] U.S. Cl. ..... 283/67; 283/58

[58] Field of Search ..... 283/57, 58, 59, 283/113, 114, 95, 78, 74

[56] References Cited

U.S. PATENT DOCUMENTS

| | | | |
|---|---|---|---|
| 1,383,792 | 7/1921 | Dickinson . | |
| 2,500,612 | 3/1950 | Krogh | 283/78 |
| 3,447,818 | 6/1969 | De Pizzol | 283/78 |
| 3,709,524 | 1/1973 | McKee et al. | 283/78 |
| 3,829,133 | 8/1974 | Smagala-Romanoff | 283/6 |
| 4,210,346 | 7/1980 | Mowry, Jr. et al. | 283/8 B |
| 4,227,719 | 10/1980 | McElligott et al. | 283/8 R |
| 4,227,720 | 10/1980 | Mowry, Jr. et al. | 283/8 R |
| 4,265,469 | 5/1981 | Mowry, Jr. et al. | 283/8 B |
| 4,310,180 | 1/1982 | Mowry, Jr. et al. | 283/8 B |
| 4,341,404 | 7/1982 | Mowry, Jr. et al. | 283/8 B |
| 4,351,547 | 9/1982 | Brooks, II | 283/8 R |
| 5,085,936 | 2/1992 | Herdman | 428/337 |
| 5,149,140 | 9/1992 | Mowry, Jr. et al. | 283/93 |
| 5,189,292 | 2/1993 | Batterman et al. | 235/494 |
| 5,263,742 | 11/1993 | Koch | 283/58 X |
| 5,375,886 | 12/1994 | Tsuchiya | 283/93 |
| 5,575,508 | 11/1996 | Diamond | 283/93 |
| 5,591,255 | 1/1997 | Small et al. | 106/21 A |
| 5,613,712 | 3/1997 | Jeffers | 283/78 |
| 5,785,353 | 7/1998 | Diamond | 283/93 |

OTHER PUBLICATIONS

Publication Entitled: "*Primer on Security Features*"; PRIMERSF, Apr. 4, 1994, pp. 1–6.

FormsTronics Sales Brochure Flyer Entitled: "*FingerprintT-securIty Sample*"; Approximately Aug. 1997.

Copy of Check Form by FormsTronics (FTI 10195); Approximately Aug. 1997.

*Primary Examiner*—Willmon Fridie, Jr.

*Attorney, Agent, or Firm*—Russell N. Rippamonti; Jenkens & Gilchrist, P.C.

[57] ABSTRACT

A negotiable document includes enhanced security for deterring the fraudulent photocopying of the subject negotiable document. The present invention includes at least one true fourdrinier watermark and/or at least one artificial watermark comprising a fingerprint and a visually perceptible watermark representation for comparison with the watermark to determine the validity of the negotiable document. The visually perceptible representation is printed with thermochromatic ink. When the visually perceptible representation is rubbed with a live human hand, heat is transferred to the thermochromatic ink. The visually perceptible representation will fade and disappear as the ink is heated by the rubbing action and heat of the hand. The negotiable document further includes a warning clause notifying the user of the disappearing properties of the visually perceptible representation.

29 Claims, 5 Drawing Sheets

NEGOTIABLE DOCUMENT HAVING ENHANCED SECURITY FOR DETERRING GENERATION OF COPIES BY USE OF THERMOCHROMATIC INK

RELATED APPLICATION

This application, entitled A NEGOTIABLE DOCUMENT HAVING ENHANCED SECURITY FOR DETERRING GENERATION OF COPIES BY USE OF THERMOCHROMATIC INK, is a continuation-in-part of U.S. Ser. No. 08/731,055, filed Oct. 9, 1996, U.S. Pat. No. 5,785,353, which is a continuation-in-part of U.S. Ser. No. 08/333,542 filed Nov. 2, 1994, now U.S. Pat. No. 5,575,508, issued Nov. 19, 1996, which is a continuation-in-part of U.S. Ser. No. 08/241,798 filed May 12, 1994, now U.S. Pat. No. 5,538,290, issued Jul. 23, 1996.

TECHNICAL FIELD

This invention relates to negotiable documents, and more particularly to a negotiable document using thermochromatic ink for deterring the fraudulent photocopying of the subject negotiable document.

BACKGROUND OF THE INVENTION

A major problem within the check cashing industry is the increasing risks arising from the copying of checks by unauthorized individuals. These risks have increased due to the improved technology in the areas of copiers, computer aided design and desk top publishing. Advancements in these areas have created the ability to duplicate checks and other negotiable documents to such a high degree of accuracy that an individual receiving the check or negotiable document has difficulty in determining if the document is fraudulent.

A variety of methods have been implemented to protect against the unauthorized copying of checks and negotiable documents. These preventative methods have included the use of multi-colored check faces and specially designed check backgrounds that are not easily copied. Some manufacturers have utilized the placement of the word "void" in a muted design that normally blends in with the background of a check but becomes visible when the check is processed through a single or full color copier. Other manufacturers use a rainbow color scheme with graduated colors from blue to green or blue to purple across the face of a check or negotiable document. The rainbow color scheme makes the check more difficult to photocopy.

Another technique utilized to protect against fraudulent checks and negotiable documents is the placement of artificial watermark certification seals upon the check or negotiable document. The seals are only apparent to an individual when viewing a check or negotiable document from an angle. The watermark certification seals cannot be copied and a warning placed upon the check or negotiable document alerts an individual to the required presence of the watermark.

However, none of these security methods protect two particularly vital areas of a check or negotiable document. The most critical areas of a check or negotiable document are the signature area and the endorsement area on the back of the check. None of the methods to date have focused upon protection of these particularly vital areas. Another problem arises from the fact that the watermark certification seals placed upon the check or negotiable document are difficult to see, making it difficult for an individual cashing the check to easily determine whether the proper watermark seal is present. Thus, a need has arisen for a method and apparatus specifically protecting the vital signature and endorsement areas of a check or negotiable document and allowing an individual to more easily determine the presence of a watermark certification seal.

Another method utilized to deter duplication of checks or negotiable documents uses a pantograph design, having a different screen density and/or different lines per inch within the screen. This causes a difference in the size of the dots making up the design, but the differences are muted to the naked eye. Warning phrases and words, such as VOID, COPY, etc., are designed within the larger or smaller dots.

If a check or negotiable document using this feature is processed through a copier or other scanning device, the larger dots are copied, but the smaller dots are not copied. Thus, the phrase encoded within the differing size dots will appear in the copy. The degree of success of this procedure depends upon the pantograph design, the ink color, the screen density and the lines per square inch of the screen. However, current technological advances in copying devices allow various settings to be used upon the copying device. Thus, by iterative procedures, an unauthorized individual could adjust the settings of a sophisticated copying device to copy a check or negotiable document in such a manner that the encoded warning clause would not appear.

SUMMARY OF THE INVENTION

The foregoing and other problems are overcome by the present invention. The negotiable document claimed in the present invention includes enhanced security for deterring the fraudulent photocopying of the subject negotiable document by use of thermochromatic ink and an artificial watermark.

The present invention includes at least one true fourdrinier watermark or at least one artificial watermark comprising a fingerprint and a visually perceptible watermark representation for comparison with the watermark to determine the validity of the negotiable document. The visually perceptible watermark representation is printed with thermochromatic ink. When the visually perceptible representation is rubbed with a live human hand, heat is transferred to the thermochromatic ink. The visually perceptible representation will fade and disappear as the ink is heated by the rubbing action and heat of the hand. The negotiable document further includes a warning clause notifying the user of the disappearing properties of the visually perceptible representation.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
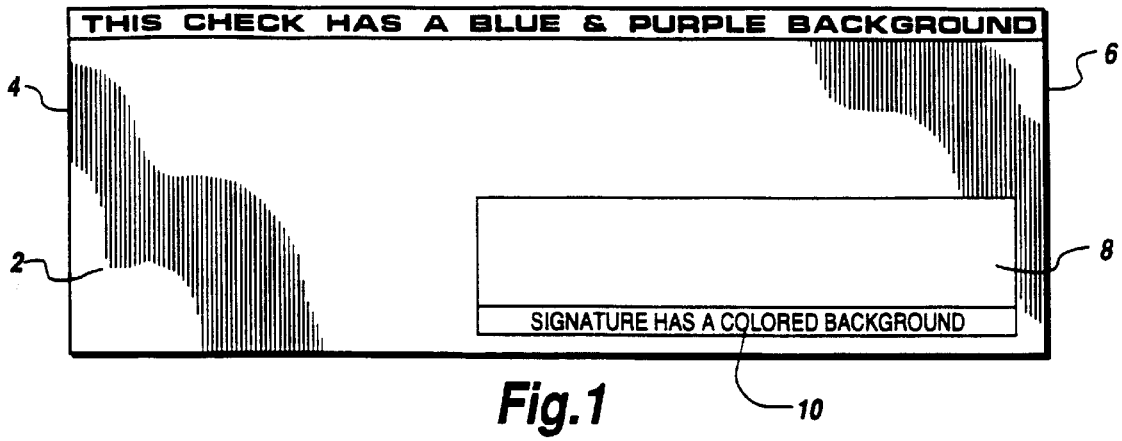
FIG. 1 illustrates the front side of a check utilizing the signature area of the present invention.

Referring now to the Drawings, and more particularly to FIG. 1, there is illustrated the front side of a check utilizing the signature area of the present invention. The check comprises a substantially rectangular sheet of paper having a check face 2, covered with a pantographic background design. As the pantographic background design proceeds from the left side 4 of the check to the right side 6 of the check, the color graduates from one color to other colors, for example, from blue to green or blue to purple. The signature area 8 of the check, comprises an area having a pantographic background design different from the design encompassing the majority of the face 2 of the check. Furthermore, as you proceed from the left side of the signature area to the right side of the signature area, a graduated color change can occur.

A warning clause 10 is placed in the signature area 8 indicating that the signature area has a colored background. The warning clause may also include an indication of the differing background within the signature area 8, refer to the presence of a watermark certification seal located somewhere on the check or describe any other relevant feature of the signature area. The warning clause 10 uses a background and print that is clearly visible prior to and after any unauthorized copying. In the preferred embodiment, this would be achieved by using a solid color background, as opposed to a pantographic background design, with the warning clause 10.

Figure 2:
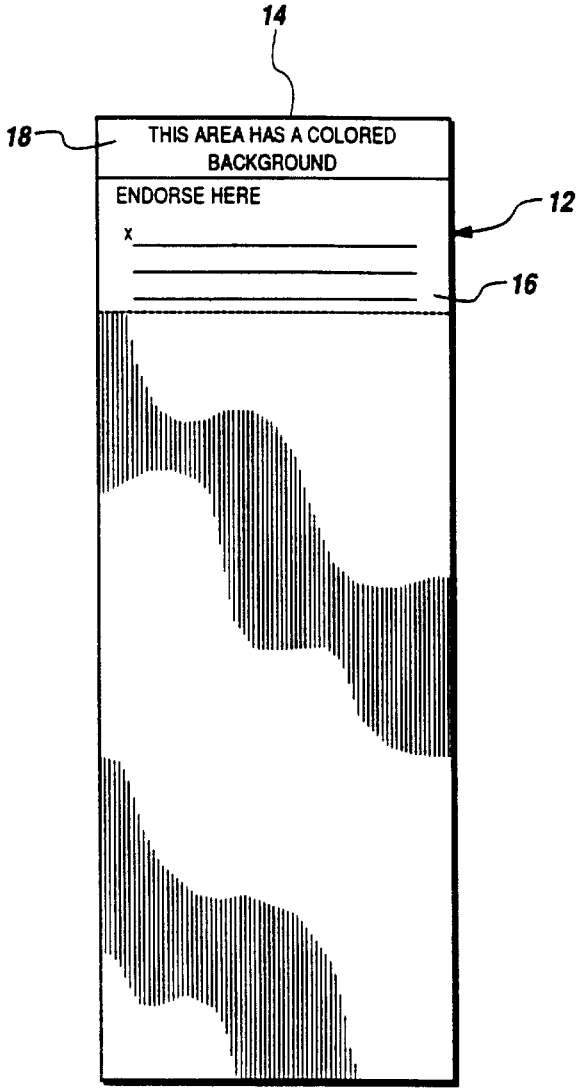
FIG. 2 is an illustration of the back of a check utilizing the endorsement area of the present invention.

Referring now to FIG. 2, there is shown the back of a check having an endorsement area printed or manufactured in accordance with the present invention. The endorsement area 12 comprises an area located at the top edge 14 of the check. The face 16 of the endorsement area 12 is covered by a pantographic background design similar to the pantographic background design on the face 2 of the check. The pantographic background design may be a single color or alternatively, may have multi-colors fading from one color to the other colors across the face 16 of the endorsement area 12.

A warning clause 18 across the top of the endorsement area 12 describes the color and/or background of the endorsement area. The warning clause 18 may further describe any relevant aspect of the endorsement area 12 and the face of check 2. The warning clause 18 is printed using a background and print that is clearly visible prior to and after any unauthorized copying. In the preferred embodiment, this would be achieved by using a solid color background, as opposed to a pantographic background design, with the warning clause 18. While the description with respect to FIGS. 1 and 2 were made with respect to a check, it is to be understood that the invention is applicable to any negotiable document.

Figure 3:
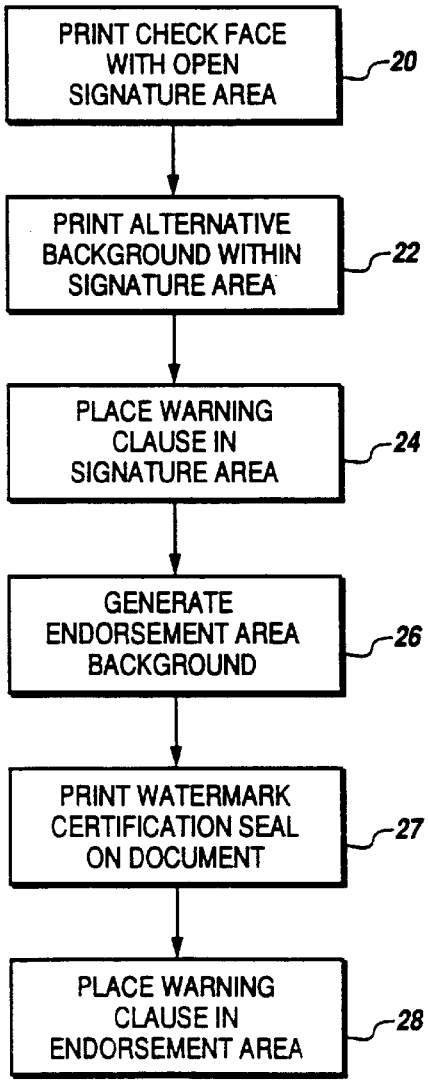
FIG. 3 is a flow diagram describing the process of the present invention.

Referring now to FIG. 3, there is shown a block diagram illustrating the process of the present invention. The check face is printed at step 20. At step 22, the signature area is also printed with an alternative background and a color scheme similar to that of the remainder of the face of the check. At step 24, the warning clause is placed in the signature area of the check to describe the background and/or color of the signature area. The endorsement area background is generated at step 26 within the endorsement area to have a pantographic background design similar to the design on the front of the check. The watermark certification seal representation is printed on the check at step 27 to provide an individual with a quick reference as to the appearance of the watermark certification seals printed on the check. The representation will normally be placed within the endorsement area but this is not required. A warning clause is placed at step 28 in the endorsement area of the check to describe the background and/or color of the endorsement area.

Figure 4:
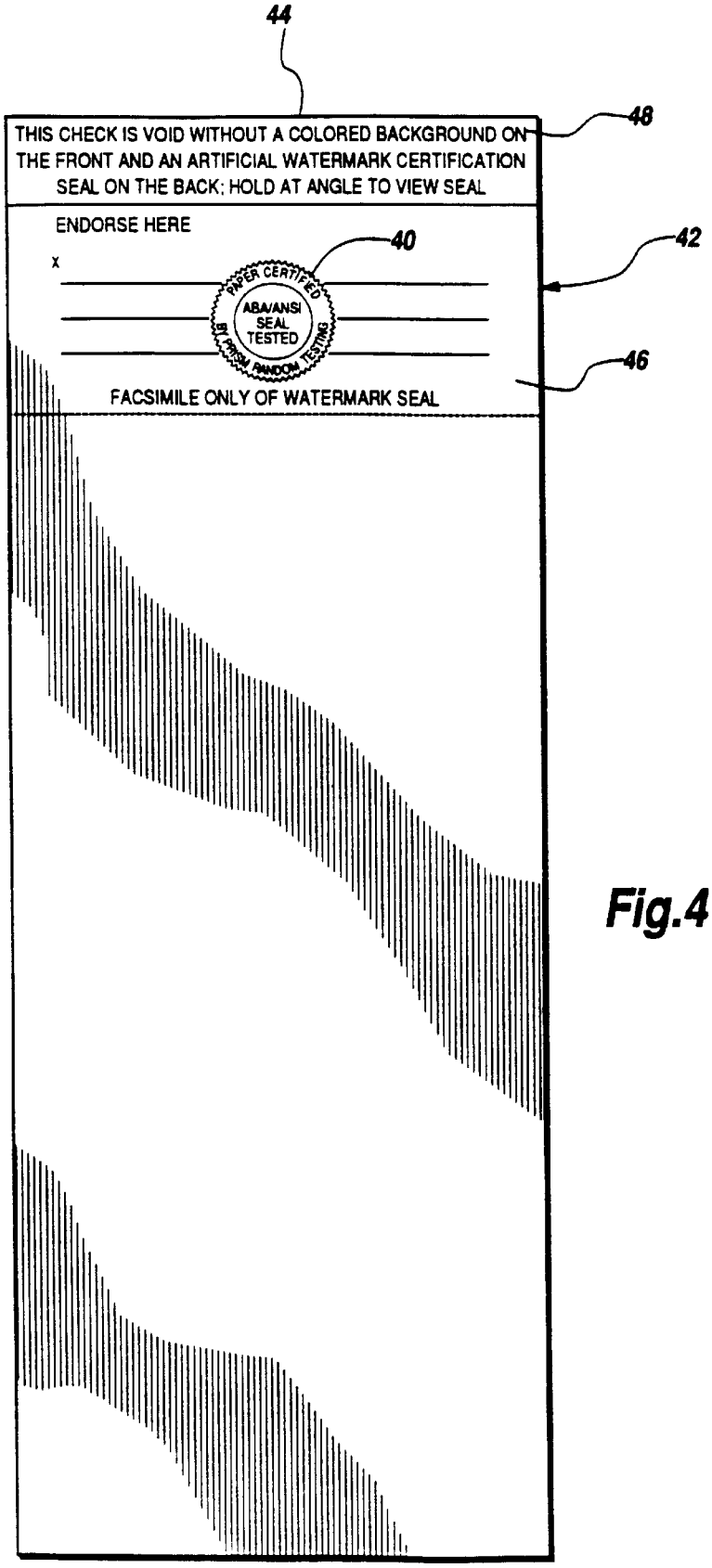
FIG. 4 is an illustration of an alternative embodiment of the back of a check having an endorsement area containing a representation of the watermark certification seals incorporated onto the check.

Referring now to FIG. 4, there is shown an alternative embodiment of the present invention wherein a watermark certification seal representation 40 is incorporated into the background of the check endorsement area 42. As before, the endorsement area 42 comprises an area located at the top edge 44 of the check. The face 46 of the endorsement area 42 is covered by a pantographic background design similar to the pantographic background design on the front face 2 (FIG. 1) of the check. At some location within the endorsement area 42, the watermark certification seal representation 40 is included. The watermark certification seal representation 40 is a replica of the artificial watermark certification seals (not shown) placed upon other locations of the check or negotiable document. A notification 41 placed at the bottom of the endorsement area 42 notifies a user that the watermark certification seal representation 40 is only a facsimile of the actual watermark certification seal (not shown). By placing the watermark certification seal representation 40 within the endorsement area 42, an individual can quickly determine what they are looking for when trying to ascertain the existence of an artificial watermark certification seal in other locations on the check. As in FIG. 2 a warning clause 48 notifies users of various security features used on the check.

Figure 5:
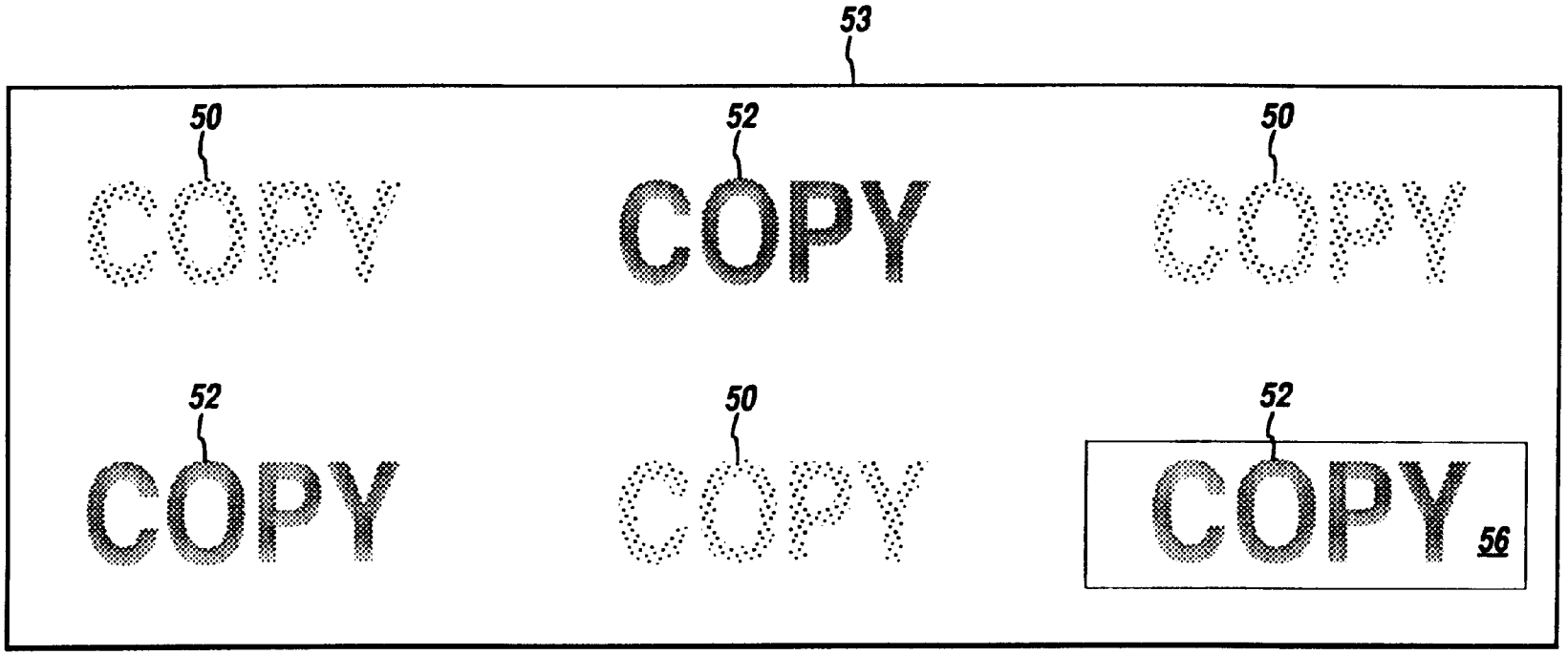
FIG. 5 is an illustration of a check having warning phrases of differing dot pattern sizes encoded in the background of the check.

Yet another method for protecting checks and negotiable documents is illustrated in FIG. 5, wherein muted warning phrases, such as VOID or COPY, are included within the background area of the check. Presently existing protection methods utilize known methods to create a warning phrase or group of warning phrases having a uniform number of line or dots per square inch. While this method protects a check or negotiable document from being copied on a majority of existing copying systems, many presently existing, more sophisticated copying systems may be set to a particular copying level such that the warning clauses would remain muted in a copied document.

Thus, the present invention utilizes a check or negotiable document incorporating warning phrases having two or more different types of line or dot densities upon the face of the check or negotiable document. A first group of warning phrases 50 uses a pattern of dots of a first size. Along with this first group of warning phrases is a second group of warning phrases 52 created from a different screen density and/or different lines per inch on the screen and having a pattern of dots of a second size. Surrounding the first and second groups of warning phrases (50, 52) is a background pattern 53 of dots having a third size. Generation of the warning clauses and background are accomplished using methods known in the art.

The differing warning phrases (50, 52) may be placed on different portions of the check or negotiable document. For example, the first group of warning phrases may be placed on the background of the majority of the document while the second group of warning phrases are placed in the background of the signature area 56. The differing groups of warning phrases (50, 52) may also be used within the same area of the check or negotiable document. By using a plurality of line or dot densities for the warning phrases (50, 52), an unauthorized individual will be unable to adjust a copier to mask a single warning phrase (50, 52) since the other warning phrase will still appear. Thus, the warning phrases will appear when copied on a greater number of copiers and copier settings than is possible using only a single line or dot density pattern.

Figure 6:
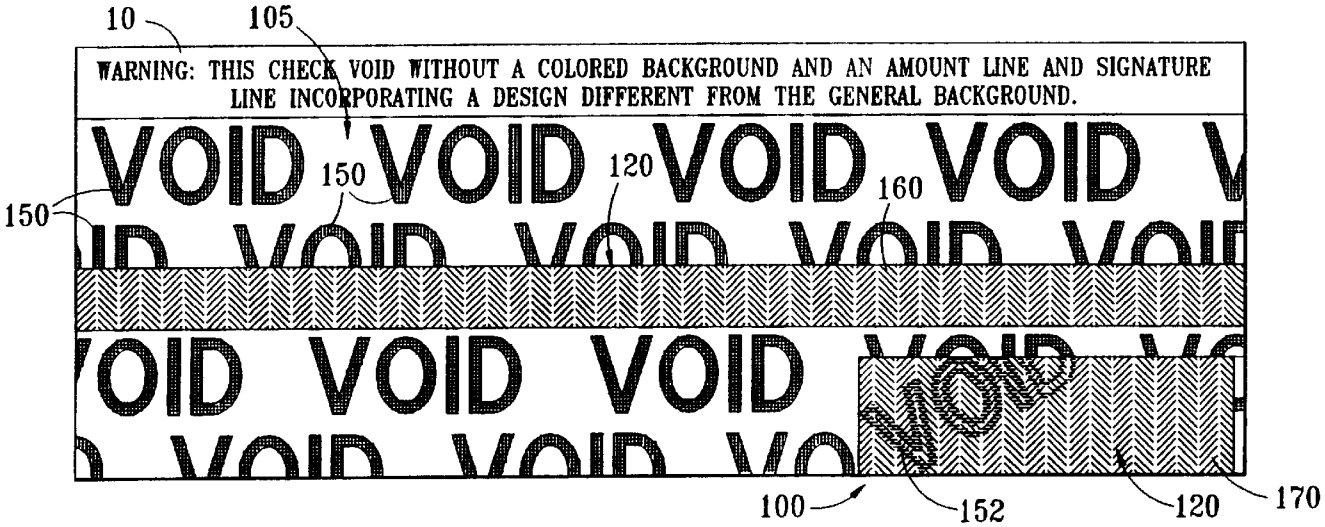
FIG. 6 illustrates the appearance of a typical photocopy of a check having a pantographic background located in the amount line and signature line different from the general background of the check and incorporating warning phrases of a first and second dot sizes.
Figure 7:
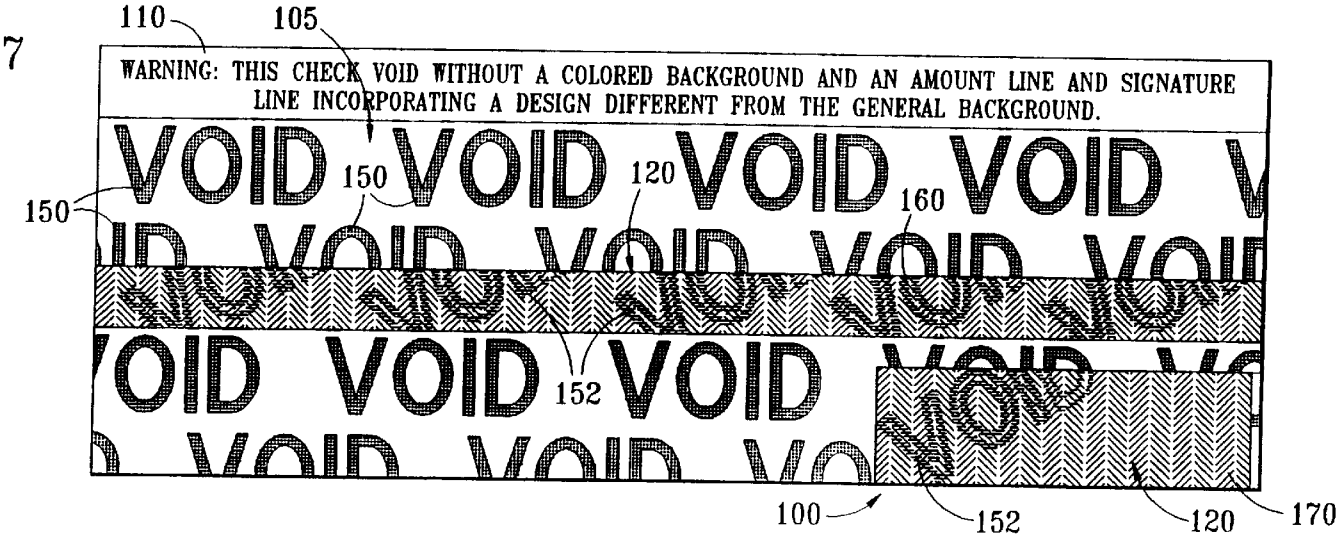
FIG. 7 illustrates the appearance of a photocopy of the check of FIG. 6 made on a different light setting of the same photocopy machine.

FIGS. 6 and 7 illustrate the appearance of typical photocopies of the front face of an alternate embodiment of the present invention. The alternate embodiment 100 includes a first pantographic design 105 positioned as the general background of the front face of a check 100 and a second pantographic background 120 positioned in the amount line 160 and in the signature line 170 on the front face of the check. The second pantographic design 120 is different from the first pantographic design 105. The alternate embodiment 100 further includes a muted warning phrase of a first dot size 150 incorporated in the first pantographic design 105 and a warning phrase of a second dot size 152 incorporated in the second pantographic background 120. The alternate embodiment 100 may also include a textual warning notification 110 printed on either the front face or rear face of check 100.

Alternatively, it will be understood that a similar muted warning phrase may be generated with a different first and second dot density or line density instead of a first dot size 150 and a second dot size 152. By using a plurality of line densities, dot densities, or dot sizes for the warning phrases 150 and 152, an unauthorized individual will be unable to adjust a copier to mask a single warning phrase 150 or 152 since the other warning phrase will still appear. FIGS. 6 and 7 illustrate the difference in typical photocopies of the check 100 made on different light settings of the same photocopier. Thus, the warning phrases will appear when copied on a greater number of copiers and copier settings than is possible using only a single dot size, single line density or single dot density pattern.

Figure 8:
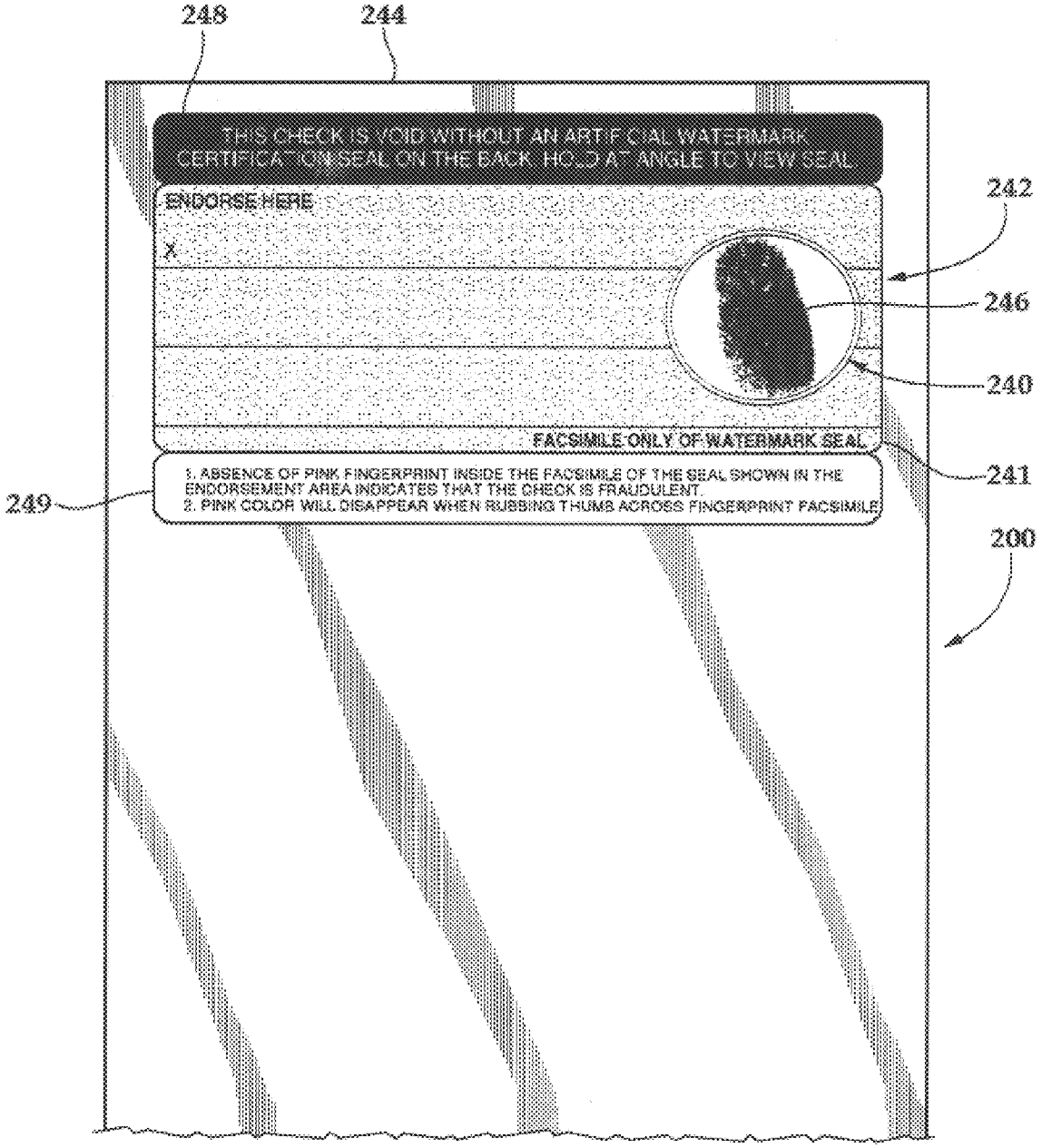
FIG. 8 illustrates an alternate embodiment of the negotiable document of the present invention using thermochromatic ink for deterring the fraudulent photocopying of the subject negotiable document.

Referring now to FIG. 8, there is shown an alternative embodiment 200 of the present invention wherein a watermark representation 240 is incorporated into the background 246 of the check endorsement area 242. The endorsement area 242 comprises an area located proximal to a top edge 244 of the check 200. The face 246 of the endorsement area 242 may be covered by a pantographic background design similar to the pantographic background design shown in FIG. 1 or alternatively may include a warning phrase generated with a different first and second dot size and/or density as illustrated and described with regard to FIGS. 6 and 7. At some location within the endorsement area 242, the watermark representation 240 is included. The watermark representation 240 is a replica of the artificial watermark (not shown) placed upon other locations of the check or negotiable document. It will be understood that a true fourdrinier watermark incorporated in the paper from which the negotiable document 200 is printed may be used instead of an artificial watermark as discussed herein.

The watermark representation 240 may comprise a fingerprint 247 or thumb print or any other body print (hereinafter referred to collectively as "fingerprint") The fingerprint may be customized by printing the actual fingerprint of an individual on whose account the negotiable document is to be drawn or the fingerprint of the person authorized to sign the negotiable document. It will be understood by those skilled in the art that the artificial watermark and the artificial watermark representation 242 may be placed at any location on the front or back side of the negotiable document and is not limited to the location as shown in FIG. 8.

It will be further understood by those skilled in the art that the artificial watermark and artificial watermark representation may comprise a certification-style seal as illustrated in FIG. 4 or may comprise other designs that may or may not incorporate a fingerprint or seal.

In the embodiment of the present invention, the watermark representation 240 is printed with a thermochromatic ink such as the ink described in U.S. Pat. No. 5,591,255 issued to Small and Highberger, the disclosure of which is incorporated herein by reference. The thermochromatic ink is commercially available from Chromatic Technology, Inc. at 4320 Northpark Dr., Suite B, Colorado Springs, Colo. 80907 under the trade name THERMOCHROMIC. The thermochromatic ink includes the thermochromatic property that when heat is transferred to the ink, the ink will visually fade and disappear. The ink begins fading at approximately 80° F. The most convenient form of heat transfer may be made by rubbing the thumb or finger of a live human hand over the watermark representation 240. The heat generated from rubbing with the human finger will be transferred to the ink and result in the fading of the ink. Heat may also be transferred to the ink by pressing the human finger against the seal as the average human body temperature of 98.6° F. is above the 80° F. point where the thermochromatic properties of the ink are activated or alternatively by rubbing the representation 240 with the thumb or finger. When the contact is stopped and the paper returns to ambient temperature the image will reappear. It will be understood by those skilled in the art that the watermark representation 240 may be configured as a fingerprint 246 as shown in FIG. 8 or as a certification seal 40 as shown in FIG. 4 or any other configuration.

In the present embodiment of the invention 200, a notification 241 is placed at the bottom of the endorsement area 242 to notify a user that the watermark representation 240 is only a facsimile of the artificial or fourdrinier watermark (not shown). By placing the watermark representation 240 within the endorsement area 242, an individual can quickly determine what they are looking for when trying to ascertain the existence of an artificial or fourdrinier watermark in other locations on the check. A warning clause 248 notifies users of the presence of the artificial or fourdrinier watermark and that the artificial watermark may be viewed by holding the check at an angle. Additionally, the check 200 will include a warning 249 that absence of the watermark representation 240 from the endorsement area indicates that the check is fraudulent and that the representation 240 will disappear when rubbing a thumb or finger across the representation 240 because of the thermochromatic properties of the ink.

The present invention further includes a method for enhancing security of a negotiable document and deterring copying of the negotiable document, comprising the steps of: generating an artificial watermark or fourdrinier on the negotiable document; and printing a visually perceptive watermark representation with thermochromatic ink on the negotiable document for comparison with the artificial or fourdrinier watermark to determine validity of the negotiable document. Rubbing the visually perceptible watermark representation with a human hand transfers heat to the representation and causes the thermochromatic ink to disappear. A warning clause advising of the thermochromatic property of the watermark representation is printed on the negotiable document.

Although preferred embodiments of the present invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A negotiable document having enhanced security for deterring generation of copies of the negotiable document, including:

at least one watermark comprising a fingerprint; and a visually perceptible watermark representation for comparison with the watermark to determine validity of the negotiable document.

2. The negotiable document of claim 1 further including a warning clause advising of the presence of the watermark.

3. The negotiable document of claim 1 further including a warning clause describing the color of the watermark representation.

4. The negotiable document of claim 1 wherein the visually perceptible watermark representation is printed with thermochromatic ink, wherein said visually perceptible representation will fade when heat is transferred to the representation from a live human hand.

5. The negotiable document of claim 4 further including a warning clause describing a thermochromatic property of the watermark representation.

6. The negotiable document of claim 4 wherein the watermark representation is located within an endorsement area on a back side of the negotiable document.

7. The negotiable document of claim 4 wherein the watermark representation is located within a signature area on a front side of the negotiable document.

8. The negotiable document of claim 1 wherein the watermark is a fourdrinier watermark incorporated in the paper of the negotiable document.

9. The negotiable document of claim 1 wherein the watermark is an artificial watermark printed on the paper of the negotiable document.

10. A negotiable document having enhanced security for deterring generation of copies of the negotiable document including:

at least one watermark; and a visually perceptible watermark representation for comparison with the watermark for determining validity of the negotiable document, wherein the visually perceptible watermark representation is printed with thermochromatic ink, and wherein said visually perceptible representation will fade when heat is transferred from a live human hand.

11. The negotiable document of claim 10 wherein the watermark representation is located within an endorsement area on a back side of the negotiable document.

12. The negotiable document of claim 10 wherein the watermark representation is located within a signature area on a front side of the negotiable document.

13. The negotiable document of claim 10 further including a warning clause advising of the presence of the watermark.

14. The negotiable document of claim 10 further including a warning clause describing the color of the watermark representation.

15. The negotiable document of claim 10 further including a warning clause describing a thermochromatic property of the watermark representation.

16. The negotiable document of claim 10 wherein the watermark is a fourdrinier watermark incorporated in the paper of the negotiable document.

17. The negotiable document of claim 10 wherein the watermark is an artificial watermark printed on the paper of the negotiable document.

18. A method for enhancing security of a negotiable document and deterring copying of the negotiable document, comprising the steps of:

placing a fourdrinier watermark comprising a fingerprint in the paper of the negotiable document; and placing a visually perceptible watermark representation on the negotiable document.

19. The method of claim 18 further including:

placing a warning clause advising of the presence of the fourdrinier watermark on the negotiable document.

20. A method for enhancing security of a negotiable document and deterring copying of the negotiable document, comprising the steps of:

placing an artificial watermark comprising a fingerprint in the paper of the negotiable document; and placing a visually perceptible watermark representation on the negotiable document.

21. The method of claim 20 further including:

placing a warning clause advising of the presence of the artificial watermark on the negotiable document.

22. A method for enhancing security of a negotiable document and deterring copying of the negotiable document, comprising the steps of:

placing an artificial watermark on the negotiable document; and placing a visually perceptive watermark representation on the negotiable document for comparison with the artificial watermark to determine validity of the negotiable document, wherein the visually perceptible watermark representation is printed with thermochromatic ink, and wherein said visually perceptible representation will fade when heat is transferred to the representation by contact with a live human hand.

23. The method of claim 22 further including:

placing a warning clause advising of the presence of the artificial watermark on the negotiable document.

24. The method of claim 22 further including:

placing a warning clause advising of a thermochromatic property of the watermark representation the negotiable document.

25. A method for enhancing security of a negotiable document and deterring copying of the negotiable document, comprising the steps of:

placing a fourdrinier watermark on the negotiable document; and placing a visually perceptive watermark representation on the negotiable document for comparison with the artificial watermark to determine validity of the negotiable document, wherein the visually perceptible watermark representation is printed with thermochromatic ink, and wherein said visually perceptible representation will fade when heat is transferred to the representation by contact with a live human hand.

26. The method of claim 25 further including:

placing a warning clause advising of the presence of the fourdrinier watermark on the negotiable document.

27. The method of claim 25 further including:

placing a warning clause advising of a thermochromatic property of the watermark representation the negotiable document.

28. The method of claim 25 further including:

placing the visually perceptive watermark representation in an endorsement area on a back side of the negotiable document for comparison with the fourdrinier watermark to determine validity of the negotiable document.

29. The method of claim 25 further including:

placing the visually perceptive watermark representation in a signature area on front side of the negotiable document for comparison with the fourdrinier watermark to determine validity of the negotiable document.

* * * * *